United States Patent [19]

Christiansen

[11] 4,248,366

[45] Feb. 3, 1981

[54] ADJUSTABLE BEVERAGE CONTAINER HOLDER

[76] Inventor: James S. Christiansen, 5288 Austin Rd., Santa Barbara, Calif. 93111

[21] Appl. No.: 37,816

[22] Filed: May 10, 1979

[51] Int. Cl.[3] ..... A45C 11/00

[52] U.S. Cl. ..... 224/148; 224/251; 150/52 R

[58] Field of Search ..... 224/148, 250, 251, 247, 224/231; 215/11 C, 11 E, 11 R; 248/309 R, 311.1 R, 314; 150/52 R, 11

[56] References Cited

U.S. PATENT DOCUMENTS

| | | | |
|---|---|---|---|
| 597,035 | 1/1898 | Tebbutt | 224/231 |
| 1,208,728 | 12/1916 | Bartlett et al. | 224/148 |
| 2,161,935 | 6/1939 | Roberts | 150/12 X |
| 2,494,632 | 1/1950 | Rodin | 224/148 X |
| 2,500,257 | 3/1950 | Mahan | 224/250 |
| 3,065,944 | 11/1962 | Liebendorfer | 224/148 X |
| 3,814,288 | 6/1974 | Westrich | 224/148 X |

*Primary Examiner*—Robert J. Spar
*Assistant Examiner*—Jerold M. Forsberg
*Attorney, Agent, or Firm*—Fulwider, Patton, Rieber, Lee & Utecht

[57] ABSTRACT

A beverage container carrier is formed with a sleeve-like casing and a flexible line formed in a loop. The extremities of the line are threaded through columns of apertures on either side of the casing. The extremities of the line will remain adjustably locked relative to the casing by the friction of the line through the apertures therein. A beverage container can be carried in the casing using the line as a handle or suspension loop.

9 Claims, 6 Drawing Figures

FIG. 1
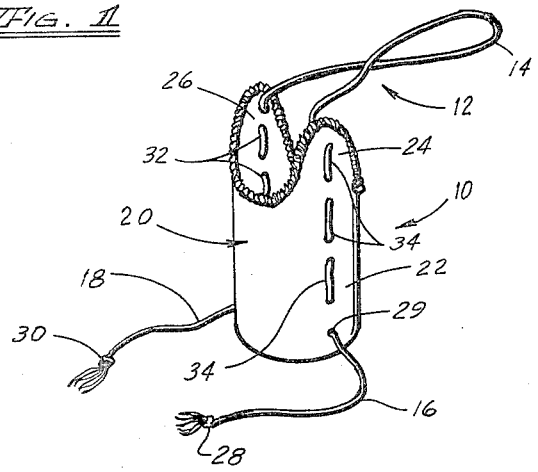
FIG. 2
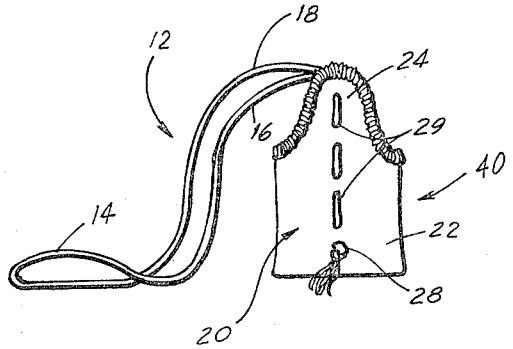
FIG. 3
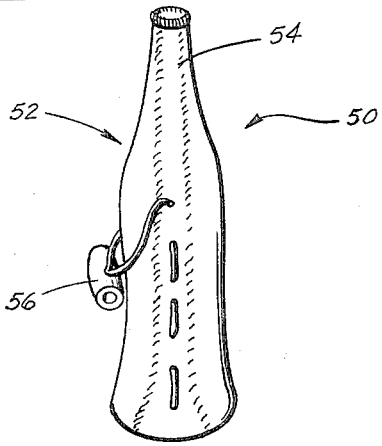
FIG. 4
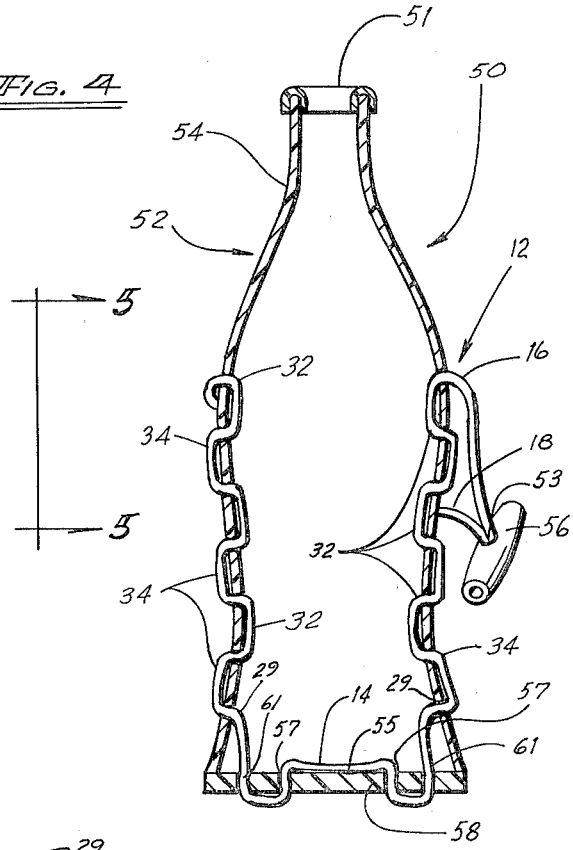
FIG. 5
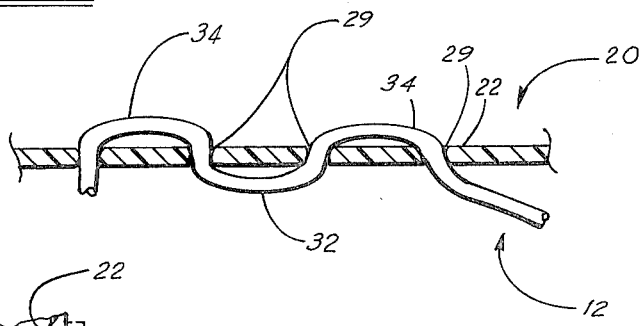
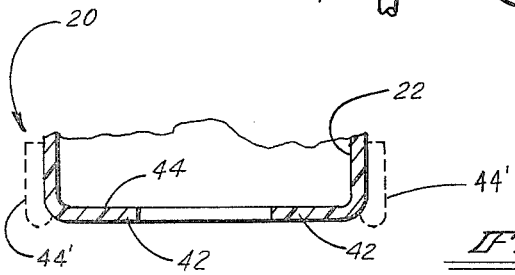
FIG. 6

ADJUSTABLE BEVERAGE CONTAINER HOLDER

BACKGROUND OF THE INVENTION

1. Field of the Invention

The present invention relates to beverage container carriers, especially carriers for individual beverage containers.

2. Description of the Prior Art

In the past various types of suspended beverage container carriers have been employed. For example, one prior art device utilizes a loop of chain which may be worn about the neck of an individual and is secured by a fastening ring at its lower extremities to a glass or cup. Such devices typically employ a loop of fixed length which cannot be adjusted after manufacture. Moreover, such conventional beverage container carriers employ devices that are rigid, and oftentimes immovably secure relative to the beverage container.

SUMMARY OF THE INVENTION

The present invention utilizes a flexible carrying line formed into a loop with trailing extremities. The extremities of the line are adjustably secured to a concave casing that snugly surrounds a beverage container. Preferably the casing is formed of a flexible thermally insulating material, such as foam neoprene. The extremities of the line need not be tied or pinned to the casing, but rather are threaded through columns of apertures in the casing that extend upward along both sides of a beverage container located therein. By providing a beverage container suspended by a line with a means for readily adjusting the length by which the carrier may be suspended, the device may be adapted for use by persons of any size and for a multitude of purposes.

In some embodiments of the invention the trailing ends of the line extend downward threaded through the columns of apertures in the casing on either side thereof. The loop can be lengthened or shortened merely by pulling one or the other or both of the extremities of line longitudinally relative to the orientation of the casing. The friction of the line through the apertures in the casing is sufficient to hold the line locked in position relative to the casing until an alternative adjustment is desired.

Some embodiments of the invention are designed as cup-shaped devices having a fixed bottom that is secured to an upwardly extending sleeve. The sleeve may terminate in a pair of upstanding ears within which the uppermost aperture in each column of apertures is located. Embodiments of the invention formed in this manner are quite useful for carrying beverages in cans and cups. The use of the upstanding ears allows a beverage container to be suspended with a much lower center of gravity. The profile between the ears allows beverage containers of different sizes to be used while inserted into the carrier of the invention, and to facilitate drinking from the container while it is in the carrier.

Another embodiment of the invention involves a removable bottom through which the loop of line passes. Again, the extremities of the line can be pulled through columns of apertures on either side of a casing, but the extremities of line extend upward, rather than downward, since the loop at the center of the line is used to entrap the removable bottom of the container within the carrier. The upward extending extremities of the line can be tied or otherwise secured together to form a carrying handle.

In still another embodiment of the invention, a flexible tube-like sleeve is provided, but is equipped with a radially inwardly directed lip at its lower extremity. The lip forms an annular bottom support for the beverage container, but may be deflected outwardly from the sleeve to allow the beverage container to be inserted or withdrawn.

By using the beverage container carrier of the invention, an individual may carry a beverage leaving both hands free while participating in vigorous activity, while at the same time thermally insulating the beverage from the surrounding environment. For example, flasks of a hot beverage, such as coffee, may be carried around the neck of individuals while traversing a ski lift or otherwise participating in winter sports. In contrast, the same device can be utilized to keep a beverage, such as beer or wine, chilled while participating in warmer weather activities, such as sailing or bicycling.

The carrier of the invention can also be employed to maintain the hands of the user free even during less strenuous activities, such as moving through crowds at races or other sporting events.

A further advantage of the invention, when it is constructed in its preferred form with a flexible casing, is that once the beverage has been consumed and the container discarded, the carrier can be easily folded or flattened and carried in the pocket or purse of a user. Furthermore, if the casing is also resilient, it more readily snugly engages the exterior surface of a container positioned therein to grip the container and to add to the functional forces holding the carrying line immobile relative to the casing until adjustment is desired.

While the invention may be constructed with a variety of different geometric configurations and materials, a casing formed of a flexible tubular structure is preferred. Foam neoprene rubber has been utilized quite satisfactorily, although other materials of varying degree of flexibility and hardness may also be utilized, such as vinyl nitrate, nitrile, epichlorohydrin, ethylene propylene, neoprene/vinyl/SBR, EPT/polyethlene/-butyl, vinyl nitrile, SBR, or vacuum formable SBR. The carrying line likewise may be formed of numerous materials. A braided nylon line is preferred, although cords or strings formed of vinyl, string, leather thongs, or other materials are equally satisfactory. The line selected should be of sufficient diameter and frictional characteristics that it will not slide or cut through the fabric of the casing under the weight of a beverage and container positioned therein.

The invention may be described with greater clarity and particularly by reference to the accompanying drawings.

DESCRIPTION OF THE DRAWINGS

FIG. 1 is a perspective view of one embodiment of the invention adapted to carry relatively tall cans or glasses.

FIG. 2 is a perspective view of an embodiment similar to FIG. 1, but adapted for shorter cans or glasses.

FIG. 3 is a perspective view of an embodiment of the device useful for carrying bottles.

FIG. 4 is a sectional view of the embodiment of FIG. 3.

FIG. 5 is a detail section of a line through a plurality of apertures in a casing.

FIG. 6 illustrates an alternative lower casing extremity.

DESCRIPTION OF THE EMBODIMENTS

A cup-shaped beverage container 10 is illustrated in FIG. 1 which includes an elongated flexible braided nylon carrying line 12 formed in a carrying loop indicated at 14 with trailing extremities 16 and 18, and with an insulating concave neoprene casing 20 formed as a tubular cylindrical sleeve 22 for snugly surrounding a beverage container. The sleeve 22 of the casing 20 is constructed with a saddle shaped upper edge contour and with a pair of opposing upstanding tongue shaped ears 24 and 26. A pair of columns of apertures 29 are defined in the casing 20 in vertical alignment with the ears 24 and 26 with the uppermost of the apertures defined in the ears 24 and 26. The columns of apertures 29 are generally vertical columns and are adaptive to receive the trailing extremities 16 and 18 of the carrying line 12 which are threaded therethrough as depicted in detail in FIG. 5. Knots 28 and 30 are tied in the trailing extremities 16 and 18, respectively, to prevent them from being inadvertently drawn entirely through the structure of the casing 20 so that rethreading through the apertures 29 is not required. Beads or some other enlarged object could be affixed to the trailing extremities 16 and 18 in place of the knots 28 and 30, if desired.

In initially constructing the beverage container 10, the trailing extremities 16 and 18 are threaded sequentially through the apertures 29, from the uppermost to the lowermost, to form interior stitches 32 at the inside surface of the casing 20 and external stitches 34 appear at the outer surface of the casing 20, as indicated in detail in FIG. 5. It is apparent that when a beverage container, such as a glass, or a can is placed into the concave interior of the casing 20, and the fit of the casing 20 thereabout is snug, the beverage container itself will tend to resist movement of the line 12 by exerting friction against the interior stitches 32. This adds to the friction resisting movement of the line 12 through the apertures 29 and further immobilizes the trailing extremities 16 and 18 of the line 12 relative to the casing 20.

The coaction of the structure of the casing 20 and the line 12 is depicted in detail in FIG. 5. The casing 20 is constructed with walls of neoprene, which is a flexible, thermal insulating material. Apertures 29 are punched in the neoprene in columns to receive the line 12. Because the casing 20 is constructed of flexible material, the structure of the casing 20 tends to close about the line 12 and to reduce the opening of the apertures 29. This increases the friction acting between the casing 20 and the line 12 at each aperture 29. The cummulative frictional force thus exerted on the line 12 prevents it from being drawn linearly along the casing 20, so that merely the weight of a beverage and container within the carrier 10 will not cause the loop 14 to be lengthened. However, when it is desired to adjust the length of the loop 14, opposite forces exerted longitudinally in the direction of the columnar alignment of the apertures 29 will be sufficient to draw the line 12 through the apertures 29.

An alternative embodiment of the beverage container carrier 40 of the invention is depicted at 40 in FIG. 2 and is similar in construction to the carrier 10. The principal difference between the two embodiments is the overall height of the device. Like the carrier 10, the beverage container carrier 40 includes a loop 14 with trailing extremities 16 and 18 threaded through upright columns of apertures 29 in a casing 20 from top to bottom.

It should be noted that the nylon line 12 of the carrier 40 has been pulled full length to increase the loop 14 to its maximum dimension. While in this position the knots 28 and 30 in the trailing extremities 16 and 18 are pulled into abutment against the outer surface of the sleeve 22 with the lowermost apertures 29 therein. The loop 14 as depicted in FIG. 1 has been shortened, on the other hand, so that the trailing extremities 16 and 18 dangle from the lowermost apertures 29 in the sleeve 22. It is to be understood that the lines 12 of both of the embodiments of FIGS. 1 and 2 can be adjusted to either of the positions depicted in those figures, relative to the casings 20, or to various other intermediate positions.

FIG. 6 illustrates another embodiment of the bottom of a casing 20. In this embodiment the neoprene sleeve 22 is formed with a radially inwardly directed lip 42 at its lower extremity. The bottom of the casing 20 is thereby created with a circular opening that defines an annular bottom support 44 for a beverage container placed therein. Since the casing 20 is constructed of flexible material, the annular support 44 may be deflected outwardly from the sleeve 22 to the dotted line position indicated at 44' to allow passage of a beverage container through the bottom of the casing 20. That is, the lip 42 can be peeled back to the position indicated at 44' and a beverage container can be forced upwardly into the casing 20. Once the bottom of the beverage container has passed, the lip 42 can be repositioned to form the annular bottom support 44, as indicated in FIG. 6.

In an alternative embodiment of the invention, the bottom closure can be formed as merely a fixed, disk-shaped end member glued or otherwise secured to the interior surface of the sleeve 22 of the casing 20.

FIGS. 3 and 4 illustrate yet another alternative beverage container carrier 50 according to the present invention, which is a wine or champagne steward, designed for use in carrying bottles. The carrier 50 is formed with a bottle shaped casing 52 formed as a sleeve with a narrow neck 54 at its top. An annular bead of stitching 51 at the upper extremity of the neck 54 prevents the uppermost edge of the neck from becoming ragged or torn during use. The walls of the sleeve 52 are perforated by parallel opposing columns of apertures through which the carrying line 12 is threaded to form the interior stitches 32 and exterior stitches 34, as with the other embodiments of the invention. Unlike the other embodiments of the invention, however, the trailing extremities 16 and 18 of the line 12 are threaded upwardly through the lowermost apertures on either side of the sleeve 52 and emerge from the sleeve 52 where it begins to taper to the neck 54. The trailing extremities 16 and 18 of the carrying line 12 pass through a lateral port 53 in a hollow wooden hand grip block 56, where the ends are tied off together so that they will not pass back through the port 53. The wooden block 56 is shaped generally like a football, but with truncated open ends. The trailing extremities 16 and 18 of the line 12 can be directed through one of these open ends for tying together and then pulled back into the interior of the hand grip block 56 to fit snugly against the interior wall thereof at the port 53.

The loop 14 at the lower end of the beverage container 50 is directed through apertures in a transverse rubber platform 58. The loop 14 extends across the upward facing surface 55 of the platform 58 and downward through radially interior apertures 57 in the platform 58, and back up through radially displaced exterior apertures 61 upward toward the lowermost apertures 29 in the casing 52. The platform 58 is preferrably constructed of a more rigid, but still resilient material, such as vinyl nitrile, and is captured by the loop 14 and trailing extremities 16 and 18 so that it cannot be entirely removed from the casing 52.

While complete removal of the tranverse platform 58 is undesirable, it is possible to displace the platform 58 from the carrying location depicted in FIG. 4 to allow a bottle to be inserted into or removed from the carrier 50. To effectuate dislodgement of the platform 58, the neck 54 and the platform 58 are grasped and pulled apart in opposite directions. The platform 58 thereby moves out of abutment with the lower edges of the sleeve 52 and the trailing extremities 16 and 18 of the line 12 pass downward through the columns of apertures 29 in the walls in the casing 52 until the gripping block 56 registers in abutment with the casing 52. The force exerted must be sufficient to overcome the frictional force between the line 12 and the apertures 29 as the line 12 passes through these apertures. The platform 58 can then be tilted and swung by the line 12 out of vertical alignment with the casing 52. A bottle can then be forced through the lower opening in the casing 52 toward the opposite extremity thereof at the neck 54, or removed in a corresponding fashion.

Once a bottle has been forced into the casing 52 with the mouth of the bottle protruding upward through the stitching 55 of the neck 54, the hand grip 56 can be grasped and used to pull the platform 58 upwardly to bring the surface 55 into abutment with the bottom of the bottle and with the lower edges of the casing 52. A bottle can thus be transported, thermally insulated, and suspended from the line 12 by means of the hand grip 56.

It can be seen that the beverage container carriers 10 and 40 can be worn about the neck of a user, or suspended from any type of support. Gravity will maintain the beverage container positioned therein in a generally upright disposition, so that spilling is avoided. This action will occur despite vigorous activity, as is encountered in sailing or in skiing. Similarly, a bottle can be carried within the carrier 50 of FIGS. 3 and 4 by the hand grip 56, likewise without danger of spilling the contents.

Preferably, the casing of the beverage container carrier of the invention is sized to snugly confine a beverage container therewithin. The neoprene casings 22 and 52 of the embodiments of FIGS. 1 and 2 and of FIGS. 3 and 4 are preferably about 0.5 centimeters thick, and the bottom platform 58 of the embodiment of FIGS. 3 and 4 is preferably about 0.9 centimeters thick. Preferably, the carrier 10 is about 15.3 centimeters in height at the ears 24 and 26, while the corresponding height of the carrier 40 is about 11.6 centimeters. The overall height of the carrier 50 is preferably about 29 centimeters, and the platform 58 is about 9.2 centimeters in diameter. The braided nylon line 12 is preferably about 0.4 centimeters in diameter. The line 12 may be any length as desired by the user.

All of the illustrated embodiments of the beverage container carrier of the invention have numerous advantages. Because of their insulating properties, they tend to maintain a temperature of a beverage container inserted therein. This eliminates the need for an ice bucket and ice, as might otherwise be required to chill soft drinks, beer, wine and champagne. Moreover, the temperature of the beverage and container within the carrier is not transferred, so that the carrier can be held against the skin of an individual without discomfort. This allows an individual to hold a chilled beverage, yet keep his or her hands warm and dry. Because of the water impervious nature of the carrier, condensation on the outside of a bottle or can is not transferred through the carrier. Not only does this keep the outside of the carrier dry, but use of the carrier will prevent beverage containers from marring furniture, or leaving rings or scratches.

A further advantage in using a carrier according to the invention is that it affords a better grip on a bottle or can in which a beverage is supplied and less mess is created from condensation or possible spills. Because of the thermal insulation of the carrier, an individual is able to enjoy a beverage throughout a serving.

The beverage container carriers of the invention are lightweight and compact and are easily stored and carried. The carriers are attractive but durable and are unbreakable and reuseable. They may be machine washed on a cool, gentle cycle. They are readily adaptable to many different beverage containers and may conveniently be placed virtually anywhere. Personalized logos, or identification and advertisements may also be printed or sewn onto the exteriors of the carriers.

The wine steward 50 fits all standard white wine and champagne bottles, and may be used for many purposes, including promotional gatherings, parties, weddings, banquets or on picnics. The wine steward may be utilized in restaurants, halls, in nightclubs or in the home. It also makes a simple yet attractive gift.

It should be understood that the various dimensions indicated are not critical to the invention, but rather represent particular embodiments that are easily adaptable to the sizes of beverage containers commonly available. Numerous variations and modifications to the embodiments depicted will undoubtedly become readily apparent to those familiar with beverage container carriers. Accordingly, the scope of the invention should not be restricted to the specific embodiments disclosed and described but rather is defined in the claims appended hereto.

I claim:

1. A beverage container carrier comprising a resilient, insulating concave, cylindrical casing for snugly surrounding a beverage container, said casing having parallel columns of at least two vertically aligned apertures located diametrically opposite each other on each side of said casing, and a flexible line is formed in a loop with trailing extremities, each of said trailing extremities being laced through the apertures in opposite ones of said vertical columns, and the resilient structure of said casing squeezes said line against said container to exert friction thereon, thereby preventing the weight of said container from causing relative movement between said casing, said container and said line, and said resilient casing elastically yields to accomodate longitudinal adjustment of said line relative to said casing when longitudinal tension on said line is exerted which exceeds the weight of a container to lengthen and shorten said loop as desired, and enlargements are located in said trailing extremities of said line below the lowermost of each of said apertures in each of said columns of apertures to limit downward movement of said casing and said container relative to said line.

2. A beverage container carrier according to claim 1 further characterized in that said casing is perforated by a pair of columns of apertures extending longitudinally along the sides of said casing, and one of said trailing line extremities is threaded through the apertures of each column and trails freely from the lowermost aperture therein.

3. A beverage container carrier according to claim 1 further characterized in that said casing is formed of neoprene.

4. A beverage container carrier according to claim 1 further characterized in that said casing is formed with a pair of upstanding ears, and at least the uppermost aperture in each column of apertures is located in one of said ears.

5. A beverage container carrier according to claim 1 further characterized in that said casing is formed as a sleeve with a transverse bottom closure affixed across the lower extremity thereof.

6. A beverage container carrier according to claim 1 further characterized in that said casing is formed as a sleeve with a radially inwardly directed lip at its lower extremity which forms an annular bottom support for said beverage container, and which may be deflected outwardly from said sleeve to allow passage of said beverage container.

7. A beverage container carrier comprising an elastic insulating concave casing for surrounding a beverage container and formed as a sleeve with a narrow neck at its top, and said casing is perforated by a pair of columns of apertures extending longitudinally along the sides of said casing, and a transverse bottom platform is located beneath said casing, and a flexible line is formed in a loop which is connected to said transverse bottom platform and which is threaded through the apertures of each column to emerge externally of said casing proximate to said neck, and said loop is long enough to permit movement of said line through the apertures in each column of apertures to permit adjustment of said transverse bottom platform relative to said casing to permit said bottom platform to be moved away from said sleeve to allow insertion and removal of a beverage container.

8. A beverage container carrier according to claim 7 further characterized in that said platform is captured by said loop and said loop emerges externally of said casing at said neck.

9. A beverage container according to claim 8 further characterized in that a hand grip is provided for said loop of line where said line emerges free from said casing at said neck.

* * * * *